US006398947B2

(12) United States Patent
Beck et al.

(10) Patent No.: US 6,398,947 B2
(45) **Date of Patent: *Jun. 4, 2002**

(54) REFORMATE UPGRADING USING ZEOLITE CATALYST

(75) Inventors: Jeffrey S. Beck, Burlington; Robert A. Crane, Jr., Monroeville; Vinaya A. Kapoor, Kirkwood Voorhees; David L. Stern, Mount Laurel, all of NJ (US); John H. Thurtell, Glen Mills, PA (US)

(73) Assignee: Exxon Mobil Oil Corporation, Fairfax, VA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/406,440

(22) Filed: Sep. 27, 1999

(51) Int. Cl.[7] ..... C10G 35/06

(52) U.S. Cl. ..... 208/65; 208/63; 208/66; 208/134; 208/137; 208/138

(58) Field of Search ..... 208/65, 135

(56) References Cited

U.S. PATENT DOCUMENTS

| | | | | |
|---|---|---|---|---|
| 3,756,942 A | | 9/1973 | Cattanach | 208/137 |
| 3,760,024 A | | 9/1973 | Cattanach | 585/415 |
| 3,845,150 A | | 10/1974 | Yan et al. | 208/135 |
| 3,856,872 A | | 12/1974 | Morrison | 585/481 |
| 3,945,913 A | | 3/1976 | Brennan et al. | 208/137 |
| 3,957,621 A | | 5/1976 | Bonacci et al. | 208/60 |
| 4,090,949 A | | 5/1978 | Owen et al. | 208/78 |
| 4,163,028 A | | 7/1979 | Tabak et al. | 585/481 |
| 4,236,996 A | | 12/1980 | Tabak et al. | 208/134 |
| 4,851,604 A | | 7/1989 | Absil et al. | 585/475 |
| RE33,323 E | * | 9/1990 | Roarty et al. | 208/79 |
| 5,100,534 A | * | 3/1992 | Le et al. | 208/70 |
| 5,365,003 A | | 11/1994 | Chang et al. | 585/470 |
| 5,395,513 A | * | 3/1995 | Chin et al. | 208/135 |
| 5,406,016 A | | 4/1995 | Cook et al. | 585/475 |
| 5,455,213 A | | 10/1995 | Chang et al. | 502/63 |
| 5,498,822 A | | 3/1996 | Eccli et al. | 585/816 |
| 5,865,986 A | | 2/1999 | Buchanan et al. | 208/65 |
| 5,905,051 A | | 5/1999 | Wu et al. | 502/60 |
| 5,952,536 A | | 9/1999 | Nacamuli et al. | 585/475 |
| 5,958,217 A | | 9/1999 | Nacamuli et al. | 208/65 |
| 6,004,452 A | | 12/1999 | Ash et al. | 208/80 |
| 6,051,128 A | * | 4/2000 | Nacamuli et al. | 208/79 |

FOREIGN PATENT DOCUMENTS

| | | |
|---|---|---|
| EP | 0816311 | 7/1998 |
| EP | 0740416 B | 1/2000 |

* cited by examiner

*Primary Examiner*—Ellen M. McAvoy

(57) ABSTRACT

The patent application discloses an integrated process for reformate upgrading. Such a process enables production of a high value product slate, by incorporating the step of reforming along with reaction/diffusion with a zeolite.

11 Claims, 3 Drawing Sheets

REFORMATE UPGRADING USING ZEOLITE CATALYST

FIELD OF THE INVENTION

This invention relates to processes for conversion of hydrocarbons. More specifically, the invention relates to processes for upgrading reformate, in conjunction with naphtha reforming.

BACKGROUND

The present invention relates to processes for upgrading the reformate product of an effluent stream from a reforming unit. Specifically, the present invention relates to processes of upgrading for increasing the benzene, xylene and $C_5$-content of a reformate product.

Benzene is a highly valuable product for use as a chemical raw material. Xylene and, in particular, para-xylene, is a valuable chemical feedstock which can be separated for use in the synthesis of polyesters from mixed xylenes by fractional crystallization, selective adsorption, or membrane separation.

The presence of benzene and xylene in petroleum and other naphthas has long been recognized and many techniques have been described for recovery of the single ring aromatics from their admixture with aliphatic hydrocarbons of like boiling point. Early practice favored extraction with selective solvents to separate aromatics from aliphatics. The aromatic concentrate so derived was readily distilled to yield benzene and toluene of desired purity. The four $C_8$ aromatics, ethylbenzene (EB) and the three xylene isomers posed a more difficult problem because of their boiling points which are within the narrow range of 277.1° F. for EB to 292° F. for orthoxylene (o-xylene). The great differences in freezing point provided a basis for separating $C_8$ components by fractional crystallization. Extensive facilities were installed for recovery of para-xylene (p-xylene) in this manner,after which the $C_8$ aromatics mixture lean in p-xylene could be subjected to catalytic isomerization to generate additional desired p-xylene from o-xylene and meta-xylene (m-xylene) and the product enriched in p-xylene recycled to the fractional crystallization stage. This left EB unchanged to accumulate in the isomerizer/crystallizer "loop" unless steps could be taken to remove it.

One approach to that problem of EB build-up was the Octafining process which isomerizes xylenes under hydrogen pressure in the presence of platinum on silica-alumina catalyst. Under Octafining conditions, EB is hydrogenated to ethylcyclohexane, isomerized to dimethylcyclohexane and dehydrogenated to xylene. Concurrent conversion of xylene to undesired by-products is such as to result in net loss of xylene despite the conversion of EB to xylene. That history of Octafining is set out in more detail by U.S. Pat. No. 3,856,872, which is incorporated herein by reference, and which discloses isomerization in the presence of a catalyst in which the acidic component is a zeolite such as ZSM-5.

As commercial use of xylene has increased, isomerization of the other C8 aromatics to produce equilibrium mixtures of xylenes, and thus increase the yields of the desired xylenes, has become increasingly important. At present, several xylene isomerization processes are available and in commercial use. For example, U.S. Pat. Nos. 4,163,028 and 4,236,996, both of which are issued to Tabak et al. and incorporated herein by reference thereto, disclose processes for isomerizing xylene and converting ethylbenzene to benzene at high temperatures in the presence of a ZSM-5 catalyst. The processes provide for the conversion of ethylbenzene to benzene without the loss of xylenes by disproportionation.

One process which as been employed for the conversion of paraffins and/or olefins to aromatics is M-2 Forming, which is described in U.S. Pat. Nos. 3,760,024 and 3,756,942 to Cattanach, U.S. Pat. No. 3,845,150 to Yan et al., U.S. Pat. No. 4,090,949 to Owen et al. These patents are also incorporated herein by reference in their entirety. M-2 forming is concerned with upgrading relatively poor quality olefinic gasoline, for example, by conversion thereof in the presence of hydrogen and/or carbon hydrogen contributing fragments and an acid function catalyst comprising a crystalline zeolite of selected pore characteristics, such as ZSM-5.

U.S. Pat. Nos. 4,851,604; 5,365,003;5455,213 and 5,498,822 discloses the MTPX process, which is a method for converting toluene to para-xylene. Shape selective hydrocarbon conversions are effected by modifying a catalytic molecular sieve, such as ZSM-5, which has been selectivated by contact with a silicon selectivating agent selected from the group consisting of silicones and silicone polymers. The silicon-containing selectivating agent is present in an organic carrier. The molecular sieve is subsequently calcined. The conversion conditions comprise a temperature of from about 100° C. to about 760° C., a pressure of from about 0.1 atmosphere to about 200 atmospheres, a weight hourly space velocity of from about 0.08 to about 2000, and a hydrogen/hydrocarbon mole ratio of from about 0 to about 100.

U.S. Pat. No. 5,406,016 discloses a process for simultaneously converting benzenes to predominantly methylbenzenes and simultaneously reducing the concentration of $C_{10}$+ alkyl aromatics in a naphtha boiling range refinery process stream. The stream is contacted at a temperature in the range of about 250° C. to 450° C., and a pressure of about 400 to 2500 psig, with a 12-ring zeolitic material such as USY, faujasites and zeolite beta. The zeolite is loaded with a metal having a hydrogenation function, such as Re.

A process for transalkylation of alkylaromatic hydrocarbons is disclosed in EP 816311A. This process exhibits a percentage conversion of ethyltoluene higher than 50 wt %. The hydrocarbons are contacted with a catalyst composed of mordenite (100 pbw), inorganic oxide and/or clay (25–150 pbw), and at least one metal component selected from rhenium, platinum and nickel. Xylenes are a preferred product.

The effluent stream from a reformer contains chemicals which may be converted to more valuable products, such as benzenes and xylenes. For example, reformate typically contains significant amounts of n-paraffins which have low octane value and toluene which can be disproportionated to benzene and xylenes. Because the reformate is already at elevated temperature, the stream is highly suitable for further conversion over a catalyst, preferably a shape selective zeolite. Specifically, the desired reactions which can be achieved using a catalyst comprising a shape-selective zeolite catalyst are: conversion of n-alkanes with low conversion of isoalkanes, dealkylation of alkylated aromatics (e.g. ethylbenzene, p-ethyltoluene, propylbenzenes, etc.), toluene disproportionation to xylenes and benzene, and selective toluene disproportionation to benzene and p-xylene. Catalysts suitable for toluene disproportionation may comprise zeolites, or non-zeolitic materials, although shape selective zeolites are preferred. The process schemes described herein have the most potential value at refineries where chemicals are highly valued.

Most previous processes employing reformate upgrading have used as feed reformate that had been fractionated prior to entering the upgrading reactor.

U.S. Pat. No. 5,865,986 discloses a process for upgrading a petroleum naphtha fraction. The naphtha is subjected to reforming and the reformate is cascaded to a benzene and toluene synthesis zone over a benzene and toluene synthesis catalyst comprising a molecular sieve of low acid activity. The preferred molecular sieve is steamed ZSM-5. The benzene and toluene synthesis zone is operated under conditions compatible with the conditions of the reformer such as pressures of above about 50 psig (446 kPa) and temperatures above about 800° F. (427° C.). In one aspect of the invention, the benzene and toluene synthesis catalyst includes a metal hydrogenation component such as cobalt, nickel, platinum or palladium. In one mode of operation, the benzene and toluene synthesis catalyst replaces at least a portion of the catalyst of the reformer. The process produces a product containing an increased proportion of benzene and toluene, and a reduced proportion of $C_8$ aromatics, particularly ethylbenzenes, as compared to the reformate.

The instant invention differs from that disclosed in '986 in that the latter primarily accomplishes dealkylation of heavy ($C_9$+) aromatics. '986 identified Pd-impregnated low-activity ZSM-5 (approximately 10 alpha) as the preferred catalyst for obtaining higher BTX yields. For the instant invention, the emphasis is on toluene disproportionation rather than dealkylation of heavy aromatics. Zeolite catalysts that exhibit toluene disproportionation activity are the most suitable.

SUMMARY

This application discloses an integrated process for reformate upgrading. Such a process enables production of a high value product slate, at potentially low cost since the existing reformate stream already contains hydrogen and is at elevated temperature. The step of reforming is incorporated along with reaction/diffusion with a zeolite. In the instant invention, reformate upgrading occurs prior to fractionation. Furthermore, the upgrading catalyst performs toluene disproportionation, ethyl benzene dealkylation and/or cracking of paraffins.

DETAILED DESCRIPTION OF THE INVENTION

DESCRIPTION OF THE PREFERRED EMBODIMENT

Schematic of process for upgrading entire reformate product.

Figure 1:
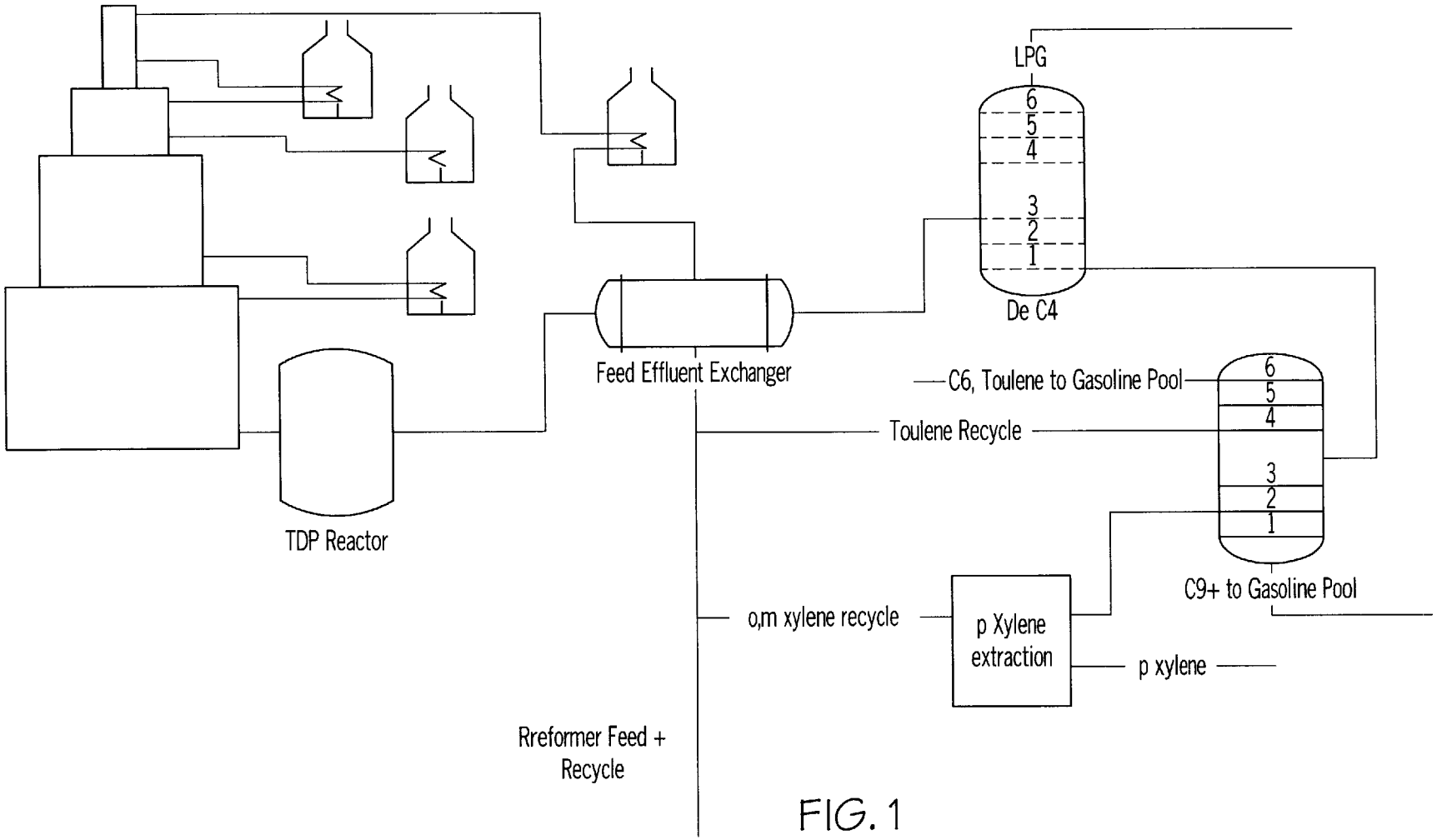
FIG. 1 illustrates the process schematic for the upgrading of the entire reformate product.

FIG. 1 represents a typical reformer loop, having a vessel for reformate upgrading [such as a TDP (toluene disproportionation) reactor] integrated into the tail end of the reformer loop. The function of the tail-end vessel may alternately be served by a final catalyst bed (in a fixed-bed reformer). If a separate reformate upgrading vessel is used, any type of reformer could be employed (Continuous Catalyst Regeneration Reforming or CCR, Semi-Regenerative, or Cyclic units which employ swing reactors). One or more catalyst beds may be used to achieve the desired chemistries. The integrated process to produce additional benzene and xylene can also include xylene isomerization units, product recovery units, and associated recycle streams.

In FIG. 1, the reformer effluent, or reformate, enters the TDP reactor 10. The TDP reactor is in this case the reformate upgrading reactor. Following toluene disproportionation, the effluent of vessel 10 exchanges heat with reformer feed and recycle streams in vessel 20, then proceeds to the deisobutanizer 30. The deisobutanized stream then proceeds to the fractionator 40. A portion of the toluene in the stream, along with smaller molecules passes to the gasoline pool from the fractionator. Another portion of the toluene is recycled to the reformer feed. The fraction containing xylenes, $C_8$ proceeds to the p-xylene extraction block 50 in which processes such as xylene isomerization, p-xylene recovery, and recycle to reformer feed may occur.

Conditions and Feeds

The reformate upgrading zone is to be maintained under conditions of temperature ranging from at least 572° F. (300° C.) to 2192° F. (1200° C.) and pressure of from 0 psig (103 kPa) to 1000 psig (6895kPa), WHSV of from 0 to 50/hr and a hydrogen to hydrocarbon mole ratio of from 0 to 10. The preferred ranges for the reformate upgrading zone conditions are from at least 750° F. (399° C.) to 1050° F.(560° C.), 0–400 psig (2859 kPa) a WHSV of from 0.5 to 30/hr and a hydrogen to hydrocarbon mole ratio of from 1 to 5.

Figure 2:
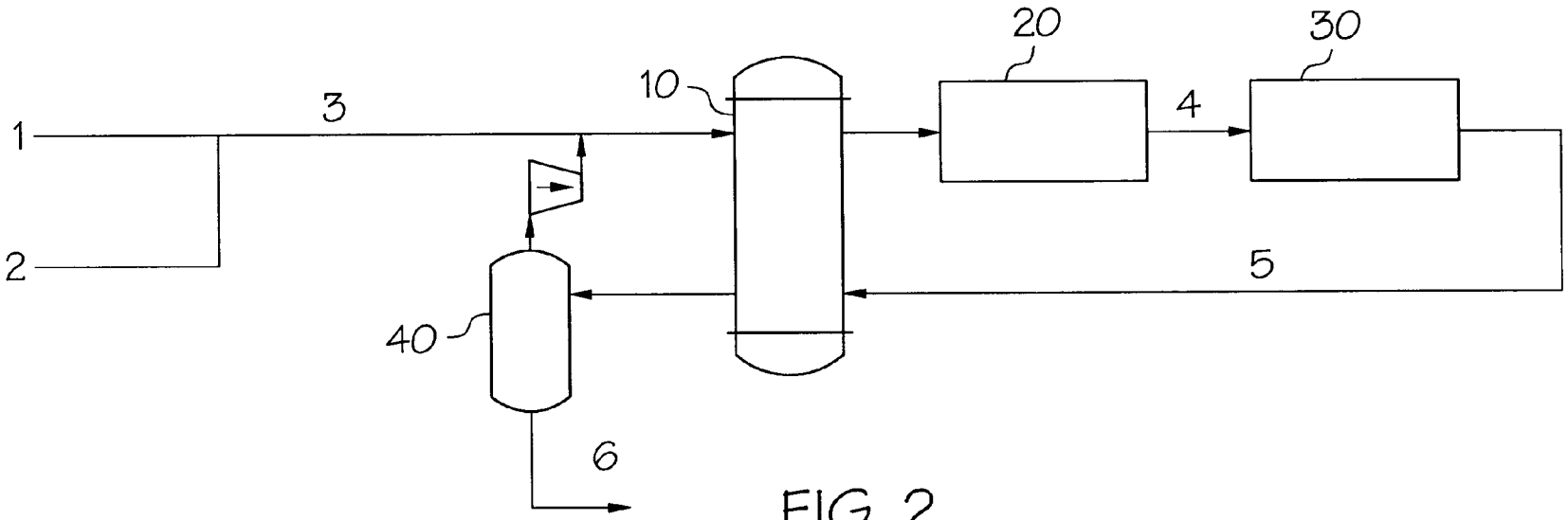
FIG. 2 represents a simplified version of FIG. 1, showing a series flow scheme.
Figure 3:
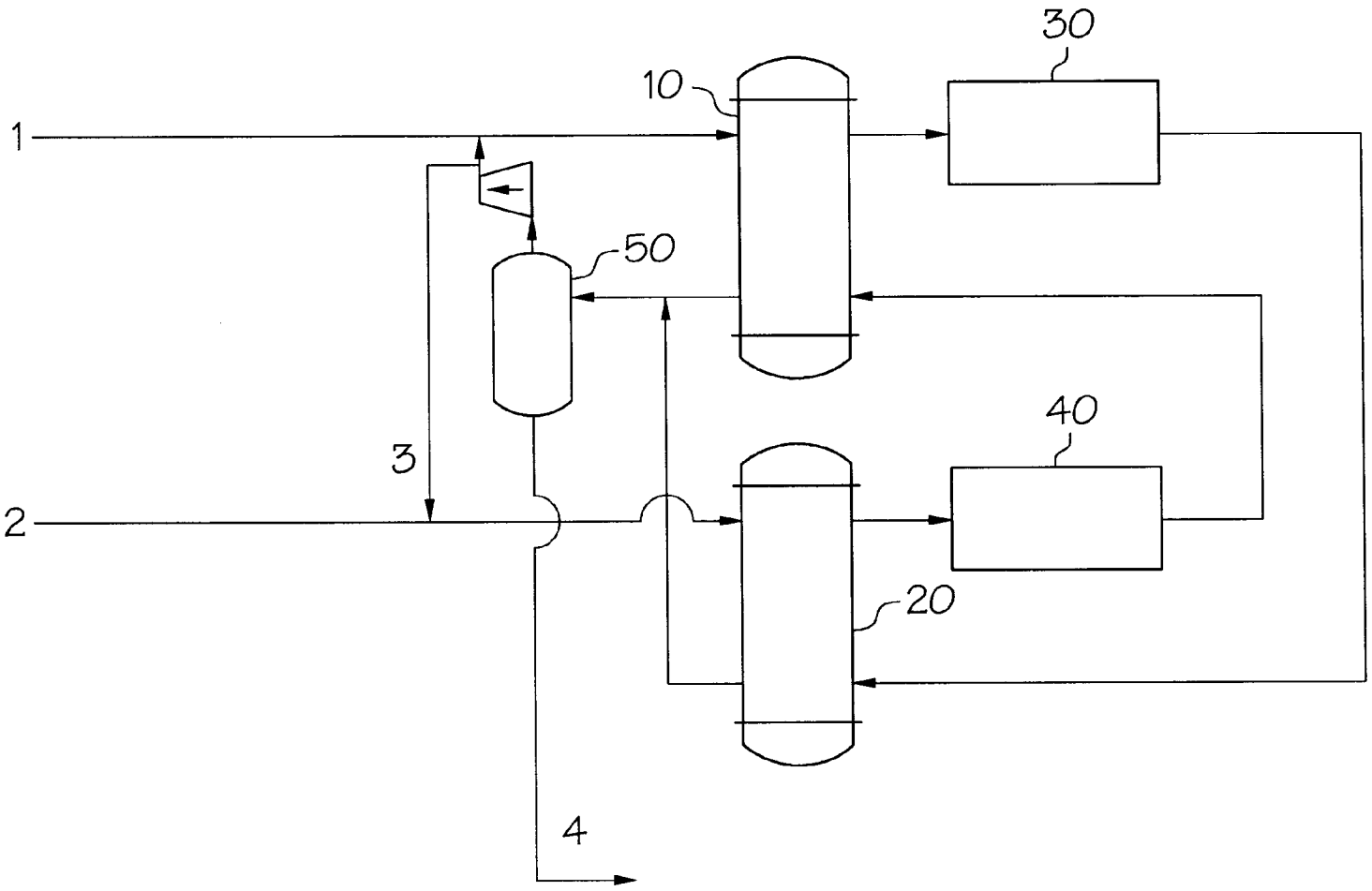
FIG. 3 illustrates a parallel flow scheme, with the upgrading vessel operating in parallel with the reformer reactors.

The feed to the reforming loops illustrated in FIGS. 1–3 may be naphtha alone or in combination with toluene. The reforming effluent which enters the upgrading zone may also be combined with streams selected from the group consisting of full range reformate, dehexanized reformate, CCR product, straight run product, or blends of toluene and reformate.

Upgrading Catalysts

The upgrading catalyst of the instant invention comprises a molecular sieve, preferably a zeolite. It is contemplated that any molecular sieve having a pore size appropriate to admit the bulky alkyl aromatic hydrocarbons and catalytically disproportionate and/or dealkylatethe aromatics can be employed in this reformate upgrading process. The molecular sieve which generally catalyzes the reformate upgrading reactions of this invention is an intermediate or large pore size zeolite having a silica-to-alumina mole ratio of at least about 12, specifically from about 12 to 1000, preferably 15–500. The zeolite is usually characterized by a Constraint Index of about 0.5 to 12. Zeolites contemplated include ZSM-5, ZSM-11, ZSM-12, ZSM-35, ZSM-38, ZSM-48, ZSM-51, zeolite beta and other similar materials. U.S. Pat. No. 3,702,886 describing and claiming ZSM-5 is incorporated herein by reference.

Additional molecular sieves contemplated include ZSM-23, described in U.S. Pat. No. 4,076,842; MCM-22 described in U.S. Pat. No. 4,962,256; and MCM-36, described in U.S. Pat. No. 5,266,541. Molecular sieves also contemplated for use in this process are the crystalline silicoaluminophosphates(SAPO), which are described in U.S. Pat. No. 4,440,871, and the aluminophosphates. (e.g. ALPO). These are described in U.S. Pat. No. 5,304,698. Examples include SAPO-11, SAPO-34, SAPO-31, SAPO-5, and SAPO-18.

For control of benzene to xylene ratio in the product, it may be desirable to employ a mixture of an intermediate pore size zeolite and a large pore size zeolite. An example of such a mixture is ZSM-5 and zeolite beta.

The molecular sieve of the instant invention, whether incorporated with a binder or in unbound form, may be contacted, preferably between about two and about six times, with a selectivating agent dissolved in an organic solvent. The selectivating agent comprises a compound or polymer containing a main group or transition metal, preferably silicon. The catalyst is contacted with a solution of the silicon-containing selectivating agent in an organic solvent at a catalyst/ selectivating agent weight ratio of from about 100/1 to about 1/10, at a temperature of from about 10° C. to about 150°C., at a pressure of from about 0 psig to about 200 psig, for a time of from about 0.1 hr to about 24 hours. The organic carrier is preferably removed, e.g., by distillation or evaporation, with or without vacuum. The catalyst is then calcined. This methodological sequence comprising the step of contacting of the catalyst with the selectivating agent solution and the step of calcining the contacted catalyst is termed a "selectivation sequence." The catalysts of the invention, then, are exposed to at least two of these selectivation sequences. U.S. Pat. No. 5,689,025, herein incorporated by reference, contains a more detailed description of silica selectivation.

As used herein, the term selectivating "agent" is used to indicate substances which will increase the shape-selectivity of a catalytic molecular sieve to the desired levels while maintaining commercially acceptable levels of hydrocarbon conversion. Such substances include, for example, organic silicon compounds such as phenylmethyl silicone, dimethyl silicone, and blends thereof which have been found to be suitable. In general, such organosilicon compounds must be soluble in organic solvents such as those described elsewhere herein. In addition, a "solution" is intended to mean a uniformly dispersed mixture of one or more substances at a molecular or ionic level. The skilled artisan will appreciate that solutions, both ideal and colloidal, differ from emulsions.

Preferably, the kinetic diameter of the high efficiency, selectivating agent is larger than the zeolite pore diameter, in order to avoid entry of the selectivating agent into the pore and any concomitant reduction in the internal activity of the catalyst.

Examples of suitable organic media (carriers) for the organosilicon selectivating agent include linear, branched, and cyclic alkanes having three or more carbons. In the methods of the present invention it is preferred that the carrier is a linear, branched, or cyclic alkane having a boiling point greater than about 70° C., and preferably containing 7 or more carbons. Optionally, mixtures of low volatility organic compounds, such as hydrocracker recycle oil, may be employed as carriers. Especially preferred low volatility hydrocarbon carriers of selectivating agents include decane and dodecane.

The upgrading catalyst of the instant invention will also exhibit diffusional properties. Those properties can be identified by noting the time (in minutes) required to sorb 30% of the equilibrium capacity of ortho-xylene at 120° C. and at an o-xylene partial pressure of 4.5+/−0.8 mm of mercury, a test described by Olson et al in U.S. Pat. Nos. 4,117,026, 4,159,282 and Re. 31,782, each of which is incorporated by reference herein. Herein, that equilibrium capacity of ortho-xylene is defined as greater than 1 gram of xylene(s) per 100 grams of zeolite.

For this invention, certain zeolite based catalysts for product upgrading in reforming processes were examined. Both selectivated and unselectivated ZSM-5 catalysts, with and without metal loading, that exhibit TDP activity were studied. Targeted chemistries include disproportionation of toluene to benzene and xylene, dealkylation of heavy aromatics and cracking of unconverted linear paraffins. The selectivated catalysts give product slates with higher p-xylene and benzene contents, at low space velocities. The unselectivated catalysts give product slates with increased benzene and mixed xylene yields, and high benzene purity (over 99.94%), even at high space velocities. The economics of toluene disproportionation in the reforming loop as described herein may have advantages over a stand-alone TDP plant.

FIG. 2 is a more simplified illustration of the flow scheme of FIG. 1, showing a "series" flow scheme. It illustrates blending of naphtha (line 1) with toluene from reformer 20 (line 2) recycled to create the feed to the reformer (line 3). The feed is heated by heat exchange with reformer upgrading reactor effluent in exchanger 10, before entering reformer 20. The reformate of line 4 enters the reformate upgrading reactor 30, where it is contacted with a catalyst comprising a zeolite. The effluent of reactor 30 (line 5) is cooled by heat exchange with feed in reactor 10 before passing to a high pressure separator 40. In the high pressure separator, light ends are compressed, and recycled to the feed while heavier materials exit the separator as product, line 6.

FIG. 3(parallel flow)

In this configuration, the reformate upgrading catalyst is contained in a separate vessel having its own feed stream (e.g., toluene cut from the reformer).

The upgrading vessel operates in parallel with the reformer reactors. The feed stream to the reformate upgrading vessel (such as toluene cut from the reformer), is processed over the reformate upgrading catalyst to produce higher value products (e.g. additional benzene and xylene). The product from the reformate upgrading vessel can then be combined with the reformer product, thus sharing 10 phase separation and extraction hardware with the reformer.

FIG. 3 is a simplified illustration, showing a "parallel" flow scheme. Naphtha (line 1) is heated separately from toluene, line 2, by heat exchange in exchangers 10 and 20 respectively. Naphtha is feed to the reformer 30, and toluene, obtained from the reformer, is feed to the reformate upgrading unit 40, where it is contacted with the upgrading catalyst. The effluents from the upgrading reactor 40 and the reformer 30 are cooled in exchanger 10 and 20 respectively, then blended prior to entering a high pressure separator 50, where light ends(line 3) are compressed and recycled to the feed while heavier materials are removed from the product (line 4).

EXAMPLE 1

The base catalyst was prepared via multiple selectivation of parent HZSM-5, with Dow-550 silicone polymer. A total of five selectivations were carried out, each attempting to add 7.8 wt % polymer onto the catalyst.

EXAMPLE 2

The feed described in the following examples is a reformate that has the composition given below.

| Component | Wt % |
|---|---|
| C5- | 3.83 |
| C6 Non-Aromatics | 5.52 |
| n-Hexane | 1.49 |
| Methylpentanes | 2.91 |
| Dimethylbutanes | 0.75 |
| C7 Non-Aromatics | 6.92 |
| C8 Non-Aromatics | 2.91 |

-continued

| Component | Wt % |
|---|---|
| Enzene | 4.01 |
| Toluene | 18.04 |
| Xylene | 19.62 |
| o-Xylene | 5.72 |
| m-Xylene | 9.60 |
| p-Xylene | 4.30 |
| Ethylbenzene | 4.05 |
| C9+ | 35.10 |

EXAMPLE 3

This example shows an enriched product in accordance with the process of the present invention. The example represents a process in which the entire reformate may be contacted over the catalyst.

The reformate of example 2 with toluene as cofeed was contacted with the catalyst of example 1 in accordance with the process of the present invention. The conditions in which the feed was contacted with the catalyst included a temperature of 950° F., a pressure of 120 psig, a WHSV of 10 $hr^{-1}$ and a $H_2$/HC (molar) of 5:1.

| | Feed(wt %) | Product (wt %) | % Change |
|---|---|---|---|
| n-Hexane | 0.72 | 0.00 | (100.00) |
| Methylpentanes | 1.39 | 1.06 | (23.83) |
| Dimethylbutanes | 0.36 | 0.34 | (4.37) |
| Benzene | 1.92 | 3.37 | 75.34 |
| Toluene | 60.72 | 58.33 | (3.93) |
| Xylene | 9.40 | 10.47 | 11.30 |
| o-Xylene | 2.74 | 2.78 | 1.46 |
| m-Xylene | 4.60 | 4.61 | 0.14 |
| p-Xylene | 2.06 | 3.08 | 49.38 |
| Ethylbenzene | 1.94 | 1.48 | (24.07) |
| C9+ | 16.82 | 16.40 | (2.45) |
| C5− | 1.83 | 4.23 | 130.44 |

The data shown clearly demonstrates the change in reformer product composition as a result toluene disproportionation to benzene and xylene as well as the dealkylation of alkyl benzenes. In particular, the content of xylenes in the reformate product increased by 11.3% and benzene increased 75.34% after undergoing the process used in this experiment. In addition, particular selectivity of p-xylene is demonstrated in the data shown.

The catalyst also accomplishes selective cracking of linear paraffins in the presence of aromatics, with minimal conversion of branched and multi-branched paraffins.

EXAMPLE 4

The example represents a process in which a portion of the reformate (split stream) is contacted over the catalyst.

The reformate product having a composition shown in example 2 with toluene as cofeed was contacted with the catalyst of example 1 in accordance with the process of the present invention. The following data were obtained using the reformate-toluene blend (reformate of Example 2) as hydrocarbon feed at 120 psig, 950° F., WHSV 1.5 $hr^{-1}$ and 5:1 molar Hydrogen:Hydrocarbon.

| | Feed(wt %) | Product (wt %) | % Change |
|---|---|---|---|
| n-Hexane | 0.73 | 0.01 | (98.63) |
| Methylpentanes | 1.42 | 0.34 | (76.06) |
| Dimethylbutanes | 0.36 | 0.34 | (7.10) |
| Benzene | 1.96 | 10.97 | 459.69 |
| Toluene | 60.0 | 46.09 | (23.18) |
| Xylenes | 9.57 | 13.64 | 42.53 |
| o-Xylene | 2.79 | 2.78 | (0.36) |
| m-Xylene | 4.69 | 4.65 | (0.85) |
| p-Xylene | 2.09 | 6.22 | 197.6 |
| Ethylbenzene | 1.98 | 0.81 | (59.09) |
| C9+ | 17.12 | 15.42 | (9.93) |
| C5− | 1.87 | 10.32 | 451.87 |

Again, the data clearly demonstrates the shift in yield structure due to selective toluene disproportionation to benzene and xylene, and dealkylation of alkylbenzenes (e.g. ethylbenzene). Note the significant increase in xylene yield, with particular selectivity to p-Xylene. The catalyst accomplishes selective cracking of linear paraffins in the presence of aromatics, with limited conversion of branched and multi-branched paraffins.

The content of xylenes in the reformate product increased by 42.53% and, in particular, and the content of p-xylenes in the reformate product increased by 198%. The content of benzene in the reformate product increased 459.69%.

EXAMPLE 5

This example represents a process where a portion of the reformate, following separation, is contacted with the catalyst, and the required hydrogen is cofeed.

The reformate of example 2 with toluene as cofeed was contacted with the catalyst of example 1 in accordance with the process of the present invention. Data were obtained at 120 psig, 950° F., WHSV 10 $hr^{-1}$ and 2.5:1 molar Hydrogen: Hydrocarbon.

| | Feed (wt %) | Product (wt %) | % Change |
|---|---|---|---|
| n-Hexane | 0.71 | 0.42 | (41.45) |
| Methylpentanes | 1.39 | 1.11 | (19.82) |
| Dimethylbutanes | 0.36 | 0.36 | (0.56) |
| Benzene | 1.91 | 3.42 | 78.67 |
| Toluene | 60.91 | 58.56 | (3.86) |
| Xylene | 9.36 | 10.23 | 9.31 |
| o-Xylene | 2.73 | 2.74 | 0.29 |
| m-Xylene | 4.58 | 4.57 | (0.25) |
| p-Xylene | 2.05 | 2.92 | 42.70 |
| Ethylbenzene | 1.93 | 1.42 | (26.72) |
| C9+ | 16.74 | 16.25 | (2.89) |
| C5− | 1.83 | 4.08 | 123.50 |

The data shown clearly demonstrates the change in reformer product composition as a result of selective toluene disproportionation to benzene and xylene as well as the dealkylation of alkyl benzenes. In particular, the content of xylenes in the reformate product increased by 9.3% and benzene increased 78.7% after undergoing the process used in this experiment. In addition, particular selectivity of p-xylene is demonstrated in the data shown.

The catalyst also accomplishes selective cracking of linear paraffins in the presence of aromatics, with minimal conversion of branched and multi-branched paraffins.

EXAMPLE 6

The rhenium on ZSM-5 catalyst was prepared by incipient wetness impregnation of HZSM-5 extrudate with an aqueous solution of ammonuim perrhenate.

EXAMPLE 7

The example represents a process in which the entire reformate stream may be contacted over a catalyst.

The reformate of example 2 with toluene as cofeed was contacted with the catalyst of example 6 in accordance with the process of the present invention. The conditions in which the reformate product was contacted with the catalyst included a temperature of 950° F., a pressure of 120 psig, a WHSV of 10 $hr^{-1}$ and a $H_2$/HC ratio of 5:1. The results of this experiment are as follows:

| | Feed (wt %) | Product (wt %) | % Change |
|---|---|---|---|
| n-Hexane | 0.74 | 0.00 | (100.00) |
| Methylpentanes | 1.43 | 0.00 | (100.00) |
| Dimethylbutanes | 0.37 | 0.00 | (100.00) |
| Benzene | 1.98 | 13.21 | 567.17 |
| Toluene | 59.62 | 42.97 | (27.93) |
| Xylenes | 9.67 | 19.75 | 104.24 |
| o-Xytene | 2.82 | 4.78 | 69.50 |
| m-Xylene | 4.83 | 10.28 | 112.84 |
| p-Xylene | 2.02 | 4.69 | 132.18 |
| Ethylbenzene | 2.00 | 0.37 | (81.50) |
| C9+ | 17.29 | 8.79 | (49.16) |
| C5− | 1.89 | 14.34 | 658.73 |

This catalyst displays significantly high activity for toluene disproportionation (TDP) and a substantial increase in benzene content of 567.17% and xylene content of 104.24%. Also evident is conversion of both n- and branched paraffins. No shape-selectivity effects are observed in either TDP or paraffin conversion, since the catalyst is unselectivated. The product stream shows significant dealkylation of alkylated aromatics as observed in the decline in C9+ yield by 49.16%. C5- content also increases significantly.

Analysis of benzene purity in the product revealed a purity of over 99.94%, due to elimination of almost all benzene coboilers. Therefore, an additional advantage of this invention is in obtaining saleable quality benzene without extraction.

We claim:

1. A multistage integrated process for upgrading a petroleum naphtha comprising the steps of (a) introducing the naphtha to a catalytic reforming stage comprising a plurality of operatively connected catalyst zones including a first catalyst zone and a last catalyst zone, the last catalyst zone being maintained under reforming conditions of temperature ranging from at least 800° F. (427° C.) to 2192° F. (1200° C.), pressure of 0 psig (103 kPa) to 1000 psig (6998 kPa), a WHSV of from 0 to 50/hr and a hydrogen to hydrocarbon mole ratio of from 0 to 10, in order to provide an intermediate product comprising aromatics and paraffins;

(b) transferring without interstage separation at least a portion of the intermediate product of the last catalyst zone, together with a toluene cofeed, to a synthesis zone for benzene and xylenes, the synthesis zone comprising at least one catalyst, wherein the synthesis zone is operatively connected to the last catalyst zone of the reforming stage of step (a), the synthesis zone being maintained under conditions of temperature ranging from at least 572° F. (300° C.) to 2192° F. (1200° C.), pressure of 0 psig (103 kPa) to 1000 (6998 kPa), a WHSV of from 0 to 50/hr and a hydrogen to hydrocarbon mole ratio of from 0 to 10, the catalyst of the synthesis zone comprising a molecular sieve having an alpha value greater than 100, and a sorption time of greater than 50 minutes based on its capacity to sorb 30% of the equilibrium capacity of ortho xylene at 120° C. and a xylene pressure of 4.5+/−0.8 mm of mercury to provide a hydrocarbon product of higher benzene and xylene content than the intermediate product of the last catalyst zone of the reforming stage.

2. The process of claim 1 wherein the conditions in the synthesis zone include a temperature ranging from at least 750° F. (399° C.) to 1050° F. (560° C.), pressure of 0 psig (103 kPa) to 400 psig (2859 kPa), a WHSV of from 0.5 to 30/hr and a hydrogen to hydrocarbon mole ratio of from 1 to 5.

3. The process of claim 1, in which the catalyst of step (b) further comprises as a hydrogenation component a metal which is selected from Group VIB, VIIB or VIII of the Periodic Table of the Elements.

4. The process of claim 1, wherein the molecular sieve of the catalyst of step (b) is selected from the group consisting of ZSM-5, ZSM-11, ZSM-12, ZSM-35, ZSM-38, ZSM-23, ZSM-48, ZSM-51, MCM-22, MCM-36, zeolite beta, SAPO-11, SAPO-34, SAPO-31, SAPO-5, and SAPO-18.

5. The process of claim 3 in which the catalyst of step (b) is a diffusion modified catalyst containing a hydrogenation component being Pt, Pd. Re, Fe, Mo, Ru or a combination thereof.

6. The process of claim 1, in which the synthesis zone of step (b) is in a vessel separate from the reforming stage of step (a), the synthesis zone of step (b) comprising a vessel selected from the group consisting of a fixed bed,moving bed, fluidized bed, or tubular regime.

7. A multistage integrated process for upgrading a petroleum naphtha comprising the steps of:

(a) introducing the naphtha to a catalytic reforming stage comprising a plurality of operatively connected catalyst zones including a first catalyst zone and a last catalyst zone, the last catalyst zone being maintained under reforming conditions of temperature ranging from at least 800° F. (482° C.) to 2192° F. (1200° C.) and pressure of from 0 psig (103 kPa) to 1000 psig (6895kPa), a WHSV of from 0 to 50/hr and a hydrogen to hydrocarbon mole ratio of from 0 to 10, in order to provide an intermediate product comprising aromatics and paraffins;

(b) passing at least a portion of the intermediate product of the last catalyst zone to a separator operated at high pressure;

(c) passing at least a portion of the lighter boiling effluent of step (b) to a mixing zone where it is combined with a stream which comprises toluene;

(d) transferring the effluent of step (c) to a synthesis zone for benzene and xylenes, the synthesis zone comprising at least one catalyst, wherein the synthesis zone is operatively connected to the last catalyst zone of the reforming stage of step (a), the synthesis zone being under conditions of temperature ranging from at least 572° F. (300° C.) to 2192° F. (1200° C.) and pressure of from 0 psig (103 kPa) to 1000 psig (6895 kPa). WHSV of from 0 to 50/hr and a hydrogen to hydrocarbon mole ratio of from 0 to 10, the catalyst of the synthesis zone comprising a molecular sieve having an alpha value greater than 100, and a sorption time of greater than 50 minutes based on its capacity to sorb 30% of the equilibrium capacity of ortho xylene at 120° C. and a xylene pressure of 4.5+/−0.8 mm of mercury, to provide a hydrocarbon product of higher benzene and xylene content than the intermediate product of the last catalyst zone of the reforming stage;

(e) combining at least a portion of the effluent of step (d) with at least a portion of the effluent of step (a), the combined stream then entering a separator, from which at least a portion of the lighter fraction is recycled to either step (a) or step (b), while the heavier fraction is removed as product.

8. The process of claim 7, wherein the conditions in the synthesis zone include a temperature ranging from at least 750° F. (399° C.) to 1050° F. (560° C.), pressure of 0 psig (103 kPa) to 400 psig (2859 kPa), a WHSV of from 0.5 to 30/hr and a hydrogen to hydrocarbon mole ratio of from 1 to 5.

9. The process of claim 7, wherein the effluent of step (c) is combined with streams selected from the group consisting of full range reformate, dehexanized reformate, CCR product, straight run product, or blends of toluene and reformate prior to entering step (d).

10. The process of claim 1 or claim 7, in which the catalyst of step (b) is subjected to one or more silica selectivation steps in order to increase the shape-selectivity of the catalyst to the desired levels while maintaining commercially acceptable levels of hydrocarbon conversion.

11. The process of claim 1 or claim 7, in which the catalyst of step (b) possesses an alpha in the range from 200 to 750.

* * * * *